US012311222B2

(12) United States Patent
Neuhaus et al.

(10) Patent No.: US 12,311,222 B2
(45) Date of Patent: May 27, 2025

(54) MULTIPURPOSE EXERCISE BENCH

(71) Applicant: OxeFit, Inc., Plano, TX (US)

(72) Inventors: Peter Neuhaus, Pensacola Beach, FL (US); Tyson Cobb, Pensacola, FL (US); Jeremy Gines, Pensacola, FL (US)

(73) Assignee: OxeFit, Inc., Plano, TX (US)

( * ) Notice: Subject to any disclaimer, the term of this patent is extended or adjusted under 35 U.S.C. 154(b) by 356 days.

(21) Appl. No.: 17/964,145

(22) Filed: Oct. 12, 2022

(65) Prior Publication Data

US 2023/0113371 A1 Apr. 13, 2023

Related U.S. Application Data

(60) Provisional application No. 63/255,354, filed on Oct. 13, 2021.

(51) Int. Cl.
*A63B 21/00* (2006.01)
*A63B 21/005* (2006.01)
*A63B 21/078* (2006.01)

(52) U.S. Cl.
CPC ..... *A63B 21/4029* (2015.10); *A63B 21/0058* (2013.01); *A63B 21/0783* (2015.10); *A63B 21/4033* (2015.10); *A63B 2225/09* (2013.01); *A63B 2225/102* (2013.01)

(58) Field of Classification Search
CPC ..... A63B 21/4029; A63B 21/0058; A63B 21/0783; A63B 21/4033; A63B 2225/09; A63B 2225/102; A63B 21/078; A63B 2022/0079; A63B 22/0076; A63B 22/0087; A63B 22/203
See application file for complete search history.

(56) References Cited

U.S. PATENT DOCUMENTS 4,813,667 A * 3/1989 Watterson ..... A63B 21/023 482/73
5,042,801 A * 8/1991 Sterba ..... A63B 21/4031 482/142
5,108,093 A * 4/1992 Watterson ..... A63B 22/0012 482/73
6,371,896 B1 * 4/2002 Kettler ..... A63B 21/4029 297/14
6,475,127 B1 * 11/2002 Koenig ..... A63B 21/078 482/142

(Continued)

FOREIGN PATENT DOCUMENTS

CN 203750104 U 8/2014
GB 2 389 319 B 6/2004

(Continued)

OTHER PUBLICATIONS

International Search Report and Written Opinion in PCT/US2022/046357 DTD Jan. 18, 2023.

*Primary Examiner* — Andrew S Lo
(74) *Attorney, Agent, or Firm* — Foley & Lardner LLP

(57) ABSTRACT

An exercise bench includes a base, a slidable seat coupled to and slidable along the base, and a removable pad positionable on frame. When the removable pad is positioned on the frame, the removable pad prevents movement of the slidable seat along the base and provides a static bench surface configured to support a user during a strength training exercise.

18 Claims, 12 Drawing Sheets

(56) References Cited

U.S. PATENT DOCUMENTS

| | | | | |
|---|---|---|---|---|
| 6,605,023 | B1 * | 8/2003 | Mobley | A63B 21/4029 482/142 |
| 11,541,264 | B1 * | 1/2023 | Mallard | A63B 21/169 |
| 11,925,829 | B1 * | 3/2024 | Gonzalez | A63B 21/4029 |
| 2003/0211920 | A1 * | 11/2003 | Mandel | A63B 21/015 482/115 |
| 2004/0135416 | A1 * | 7/2004 | Parker | A47C 9/002 297/377 |
| 2005/0032614 | A1 * | 2/2005 | Keiser | A63B 21/4029 482/142 |
| 2005/0143230 | A1 * | 6/2005 | Dalebout | A63B 23/12 482/121 |
| 2006/0100069 | A1 * | 5/2006 | Dibble | A63B 23/03525 482/100 |
| 2015/0038304 | A1 * | 2/2015 | Davenport | A63B 23/1218 482/123 |
| 2015/0072835 | A1 | 3/2015 | Kunstmann | |
| 2021/0394011 | A1 | 12/2021 | Neuhaus et al. | |
| 2022/0062738 | A1 | 3/2022 | Neuhaus et al. | |
| 2022/0233907 | A1 | 7/2022 | Cobb | |
| 2022/0233908 | A1 | 7/2022 | Neuhaus et al. | |
| 2023/0111117 | A1 * | 4/2023 | Kordecki | A63B 22/0023 482/8 |

FOREIGN PATENT DOCUMENTS

| | | | |
|---|---|---|---|
| KR | 10-1515504 | B1 | 5/2015 |
| WO | WO-2021/262442 | A1 | 12/2021 |
| WO | WO-2022/051169 | A1 | 3/2022 |
| WO | WO-2022/164824 | A1 | 8/2022 |
| WO | WO-2022/164825 | A1 | 8/2022 |

* cited by examiner

MULTIPURPOSE EXERCISE BENCH

CROSS-REFERENCE TO RELATED APPLICATIONS

This application claims the benefit of and priority to U.S. Provisional Patent Application No. 63/255,354, filed Oct. 13, 2021, the entire disclosure of which is incorporated by reference herein.

BACKGROUND

The present disclosure relates generally to exercise equipment. Traditional weight lifting or exercise benches are designed to accomplish one task: support a user during a variety of bench press exercises, shoulder press exercises, and other seated activities. A bench that could support additional types of exercises or other purposes would be advantageous.

SUMMARY

One implementation of the present disclosure is an exercise bench including a base, a slidable seat coupled to and slidable along the base, and a removable pad positionable on frame. When the removable pad is positioned on the frame, the removable pad prevents movement of the slidable seat along the base and provides a static bench surface configured to support a user during a strength training exercise.

This summary is illustrative only and is not intended to be in any way limiting.

BRIEF DESCRIPTION

DETAILED DESCRIPTION

Figure 1:
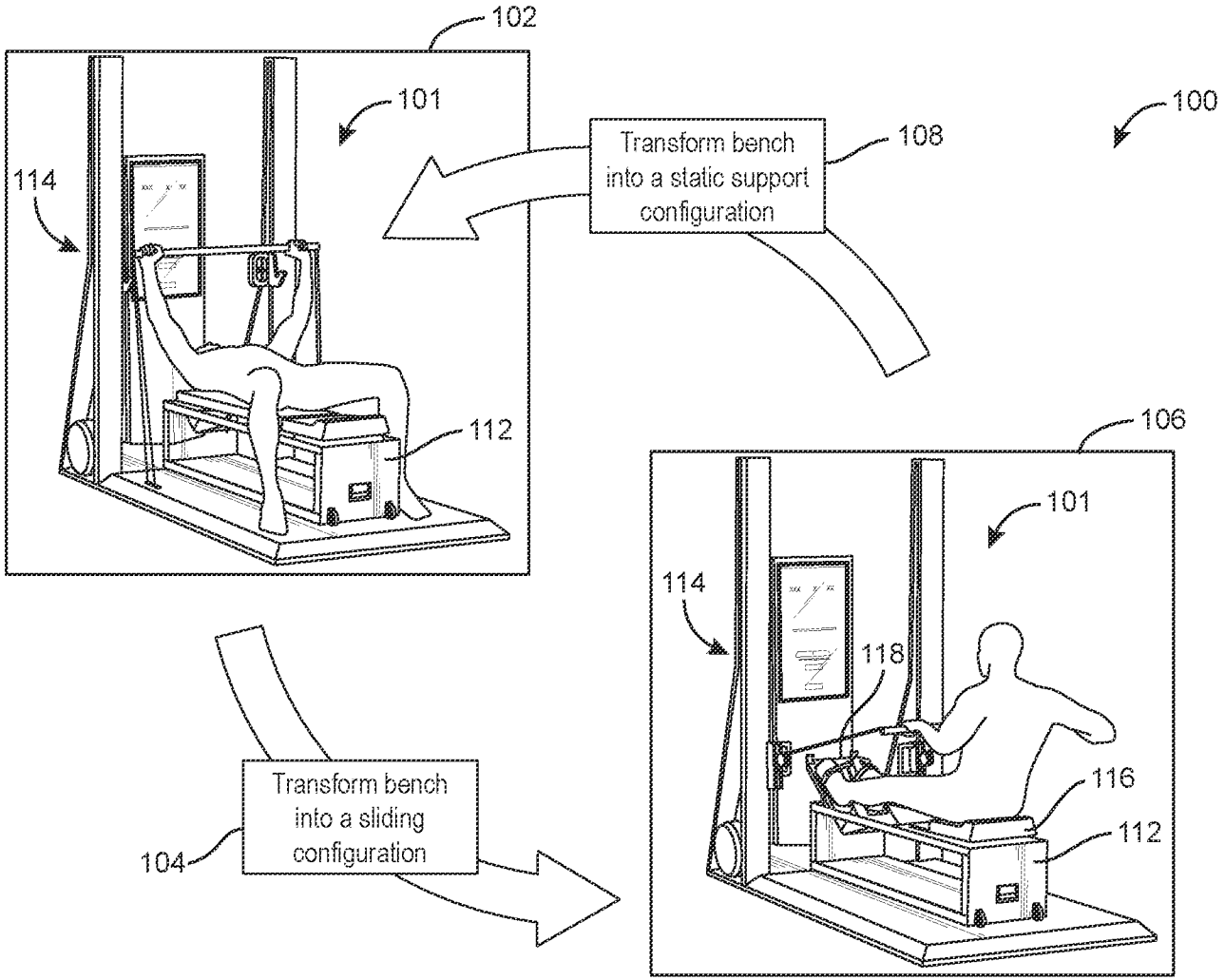
FIG. 1 is a flow diagram of a process of operating an exercise system, according to some embodiments.

Referring generally to the FIGURES, a multipurpose exercise bench is shown, in particular an exercise bench which can be used to support a user during strength training exercises such as bench press exercises and other seated activities, and which can also be used to provide a sliding seat for rowing exercises (or other paddling exercises) and/or Pilates exercises.

For weight lifting (or other seated activities), the bench has a removable bench pad that will support the weight of the user in a static support configuration. The user can lie down or sit on the bench, in a similar manner as for a traditional weight lifting bench. The bench features a removable bench pad that when removed, exposes a foot plate and seat slide that enable transformation of the bench from the static support configuration to a sliding configuration. In the sliding configuration, the bench has a sliding seat (e.g., rowing seat), which can be used for simulated rowing or other sliding exercise. The weight bench can be used for strength training activities, for example using a motorized strength training apparatus as shown in U.S. patent application Ser. No. 17/495,584, filed Oct. 6, 2021.

In the sliding configuration in some embodiments, a rowing seat can slide forward and back with little resistance along a linear track or tracks. A foot plate of the bench may include anchor points, straps, etc. to strap the user's feet to the bench in an appropriate position for rowing. In some embodiments, the rower seat can also be locked into place (e.g., with a pin lock, etc.) to allow users to use the foot plate to brace for paddling exercises, such as kayaking, in which the user's seat does not change position relative to the user's feet. The multipurpose bench can thus be used with various simulated paddling exercises as in U.S. patent application Ser. No. 17/462,237, filed Aug. 31, 2021, the entire disclosure of which is incorporated by reference herein.

In some embodiments, the sliding rowing seat can be removed and replaced with one or more seats for other fitness activities. For example, a Pilates reformer seat can be installed. The Pilates reformer seat may include a larger and more padded cushion than the rowing seat. The Pilates reformer seat could include hooks, loops, etc. to facilitate coupling of the Pilates reformer seat to cables of a force production system or springs which provide a force on the slidable seat to create an apparatus similar to the one described in U.S. patent application Ser. No. 17/495,575, filed Oct. 6, 2021, the entire disclosure of which is incorporated by reference herein. The bench with the Pilates seat forms half, the sliding part, of a Pilates reformer. An additional accessory may be included which forms a fixed or base part of the reformer, e.g., an ottoman, pedestal, box, etc. separate from the multipurpose bench.

The multipurpose bench can be easily transformed between types of activities by removing and replacing the removable bench pad of the multipurpose bench. The multipurpose bench is thus suitable for use with a motorized strength training apparatus configured as described in U.S. patent application Ser. No. 17/495,584, filed Oct. 6, 2021 and U.S. patent application Ser. No. 17/462,237, filed Aug. 31, 2021. In one example, a user can sit or lay on the cover of the multipurpose bench to perform a bench press exercise, and then can remove the cover and adjust a connection point of a handle/bar/etc. to the strength training apparatus to transition to a rowing activity. The user can then perform a rowing activity using the bench with the same force production system/strength training apparatus. After the rowing activity, the cover can be replaced to provide a bench for use with strength training activities. The sliding seat can also be removed and replaced to easily transform to Pilates exercises or other types of exercises involving a static or sliding bench. In some embodiments, the cover which provides a static bench surface includes a mechanism enabling incline or decline of the bench surface as may be desirable for various exercises. Advantageously, the teachings herein provide for a single bench that enables multiple different types of exercise, thereby saving space, materials, etc. relative to using two different benches and eliminating a challenge of moving such multiple benches to switch exercises, for example.

Referring now to FIG. 1, a flow diagram of a process 100 for operating an exercise system 101 is shown, according to some embodiments. The process 100 is illustrated a loop through a first step 102, a second step 104, a third step 106, and a fourth step 108 (which returns the process to the first step 102).

As shown for the first step 102, the exercise system 101 includes a bench 112 and an exercise apparatus 114 (e.g., a force production system). The bench 112 may be configured as described below with reference to FIGS. 2-13, in various embodiments, and the process 100 can be performed with benches of different designs in some embodiments. In the first step 102, the bench 112 is arranged in a static support configuration and statically supports a user while the user sits, lays, etc. on the bench 112.

Also as shown for the first step 102, the exercise apparatus 114 is arranged to provide a strength training exercise, shown as a bench press exercise. In some embodiments, the exercise apparatus 114 includes a motorized force production system, for example including one or more motors connected to one or more handles, grips, bars, etc. by one or more cables such that the one or more motors can operate to create forces experienced by a user holding the one or more handles, grips, bars, etc. For example, the exercise apparatus 114 can be configured as described in U.S. patent application Ser. No. 17/495,584, filed Oct. 6, 2021 and/or U.S. patent application Ser. No. 16/909,003, filed Jun. 23, 2020, the entire disclosures of which are incorporated by reference herein in their entireties. The first step 102 is thus shown as including performance of a strength training exercise (e.g., bench press) by a user laying on the bench and pushing against forces produced by the exercise apparatus 114. In other scenarios, the first step 102 may include a user performing bodyweight exercises using the bench 112 (e.g., core exercises, etc., without use of the exercise apparatus 114) and/or free weight exercises using the bench 112.

At the second step 104, the bench 112 is transformed (reconfigured, arranged, transitioned, etc.) into a sliding configuration. In some embodiments, transforming the bench 112 into a sliding configuration includes removing a removable pad or cover from the bench 112. In some embodiments, transforming the bench 112 into the sliding configuration can also include repositioning a footrest of the bench 112 from an out-of-use position to an in-use position. Transforming the bench 112 into a sliding configuration may include releasing a lock or latch (e.g., pin-lock) to enable sliding of a seat of the bench 112 along the bench 112. Such examples are described in further detail below with reference to FIGS. 2-13. The second step 104 results in the bench 112 being in a sliding configuration in which a seat of the bench 112 is slidable along the bench 112, for example as for a rowing machine.

In some embodiments, the second step 104 can also include reconfiguration the exercise apparatus 114. For example, a bar, handle, etc. of the exercise apparatus may be re-attached to different connection points of cables of the exercise apparatus in the second step 104, for example according to embodiments of U.S. patent application Ser. No. 17/495,584, filed Oct. 6, 2021, incorporated by reference herein. One or more cables of the exercise apparatus may be connected to a seat of the bench 112, in some embodiments of the second step 104. In some scenarios, the second step 104 can transition the exercise apparatus 114 from exerting a force in a substantially vertical direction (e.g., downwards, approximately perpendicular to the bench 112) to a substantially horizontal direction (e.g., approximately parallel to the bench 112). Various control logic, force programs, visual display elements, etc. of the exercise apparatus 114 may also change in the second step 104. In the example of FIG. 1, the exercise apparatus 114 is transitioned from a state in which the exercise apparatus 114 provides forces for a bench press exercise to a state in which the exercise apparatus 114 provides forces for a rowing exercise.

At the third step 106, an exercise is performed using the bench 112 in the sliding configuration. Performing the exercise can include sliding a seat of the bench 112 along the bench 112 (e.g., back-and-forth repeatedly) as part of an exercise, such as a rowing exercise. In some embodiments, the exercise performed in the third step 106 is a cardio exercise, endurance exercise, etc., for example a rowing exercise. In the example shown in FIG. 1, the user slides a seat 116 of the bench 112 along the bench 112 by pushing/pulling on a footrest 118 of the bench 112 and pulling on a bar, handle, etc. of the exercise apparatus 114. The exercise apparatus 114 may provide resistance, instructions, simulations, coaching, etc., for example as described in U.S. patent application Ser. No. 17/462,237, filed Aug. 31, 2021, the entire disclosure of which is incorporated by reference herein. In some embodiments, the third step 106 includes performing an exercises with forces exerted by the exercise apparatus 114 on the seat 116 (e.g., via cables), for example a Pilates exercise as in U.S. patent application Ser. No. 17/495,575, filed Oct. 6, 2021, the entire disclosure of which is incorporated by reference herein.

At the fourth step 108, the bench is transformed (reconfigured, arranged, transitioned, etc.) into a static support configuration. The fourth step 108 can include reversing actions taken in the second step 104, for example. The fourth step 108 can include repositioning the footrest 118 into an out-of-use position and/or placing a removable pad onto the bench 112 (e.g., adjacent the seat 116). The fourth step 108 can include manipulating a latch, pin, lock, etc. into a position which prevents movement of the seat 116, in some embodiments. As a result of the fourth step 108, the bench 112 is configured to provide static support for a user performing an exercise (e.g., a user lying or sitting on the bench 112), for example is in the first step 102 illustrated as following the fourth step 108.

The process 100 and the bench 112 thereby enable multiple different exercises to be performed using the bench 112 to provide both static support for some exercises and sliding for other exercises. Such different exercises can thereby be provided by a single bench 112, for example eliminating a bench as compared to approaches where multiple benches with different functions would need to be used. The teachings herein thus reduce the overall space and materials used for the exercise system 101, for example. It should also be appreciated that the bench transformations in the second step 104 and the fourth step 108 can be substantially easier and faster than repositioning multiple benches. Various technical benefits are thereby provided by the process 100 and the bench 112.

Figure 2:
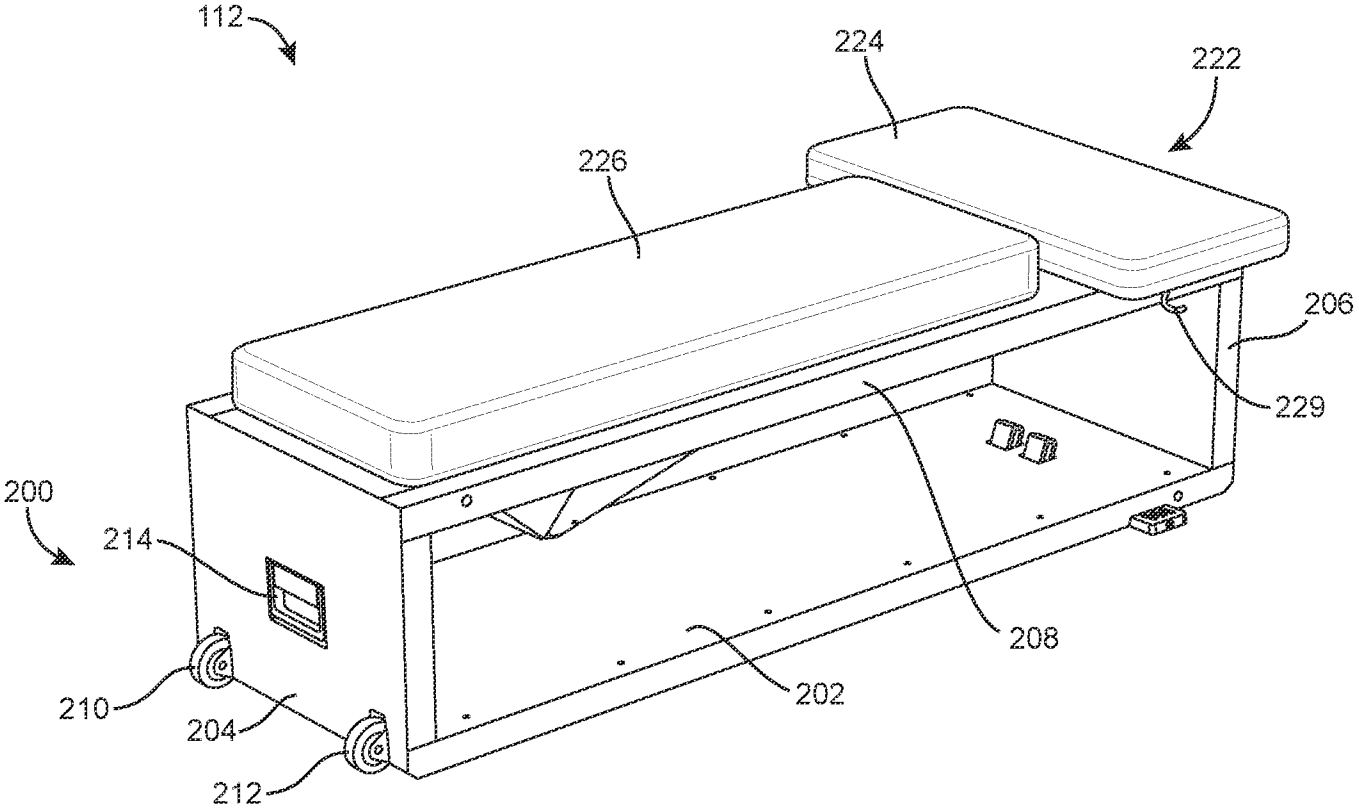
FIG. 2 is perspective view of a multipurpose bench in a static support configuration, according to some embodiments.
Figure 3:
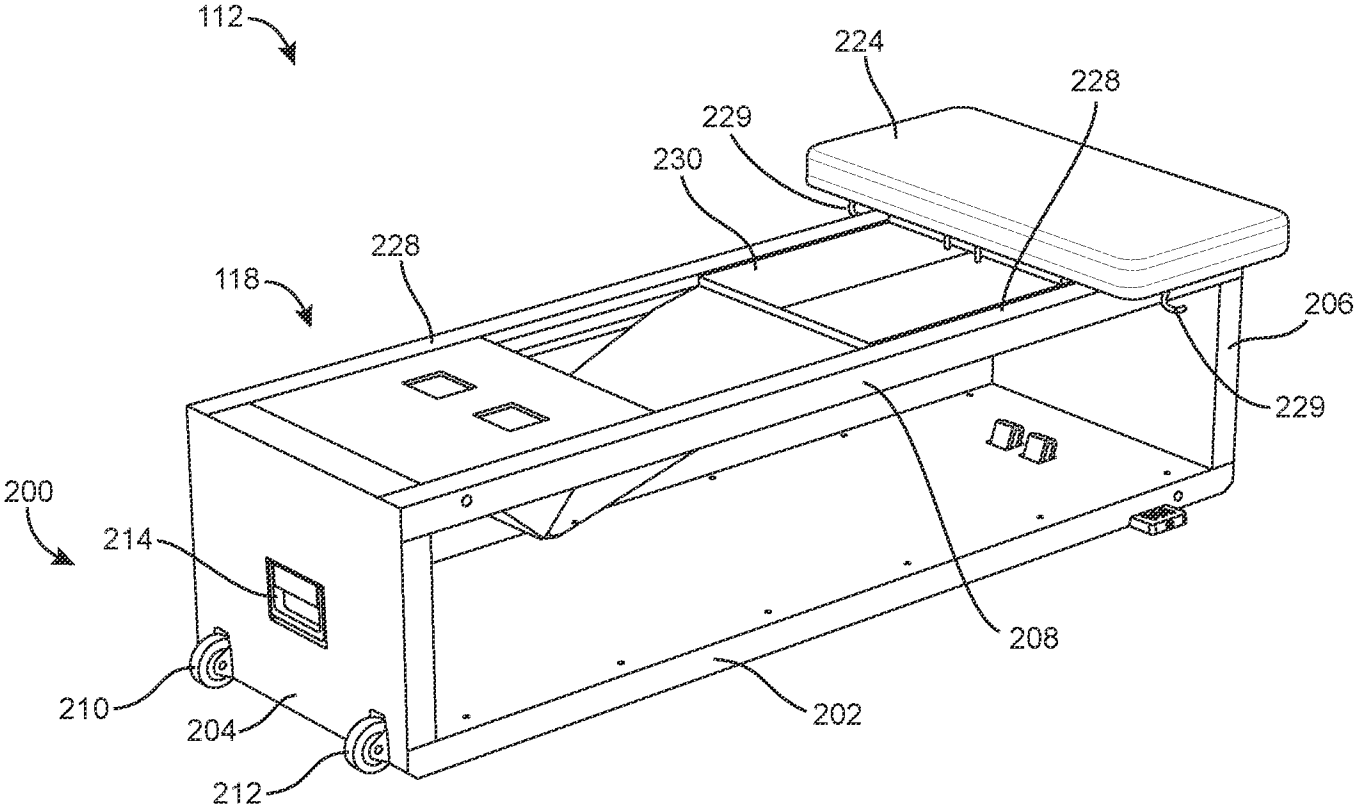
FIG. 3 is a perspective view of the multipurpose bench in a sliding configuration, according to some embodiments.
Figure 4:
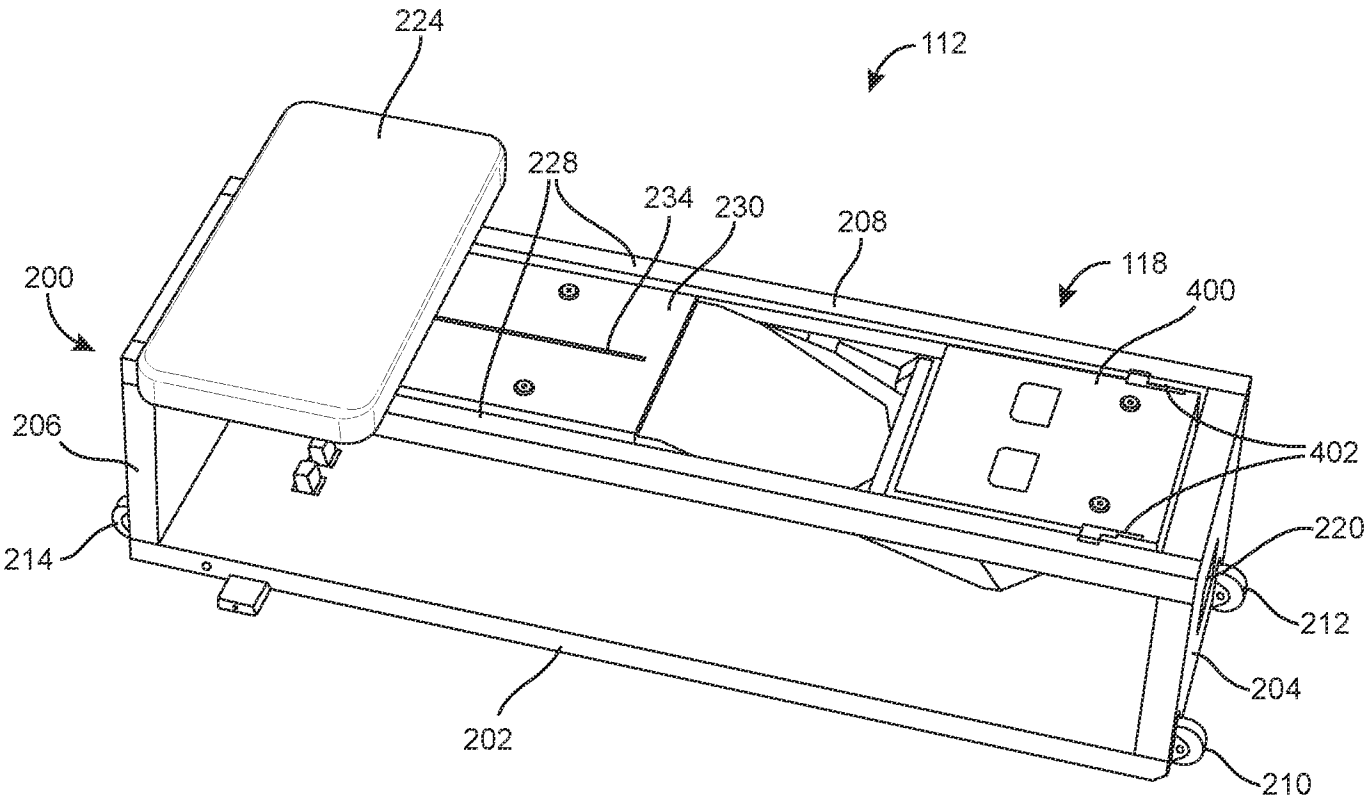
FIG. 4 is another perspective view of the multipurpose bench in a sliding configuration, according to some embodiments.
Figure 5:
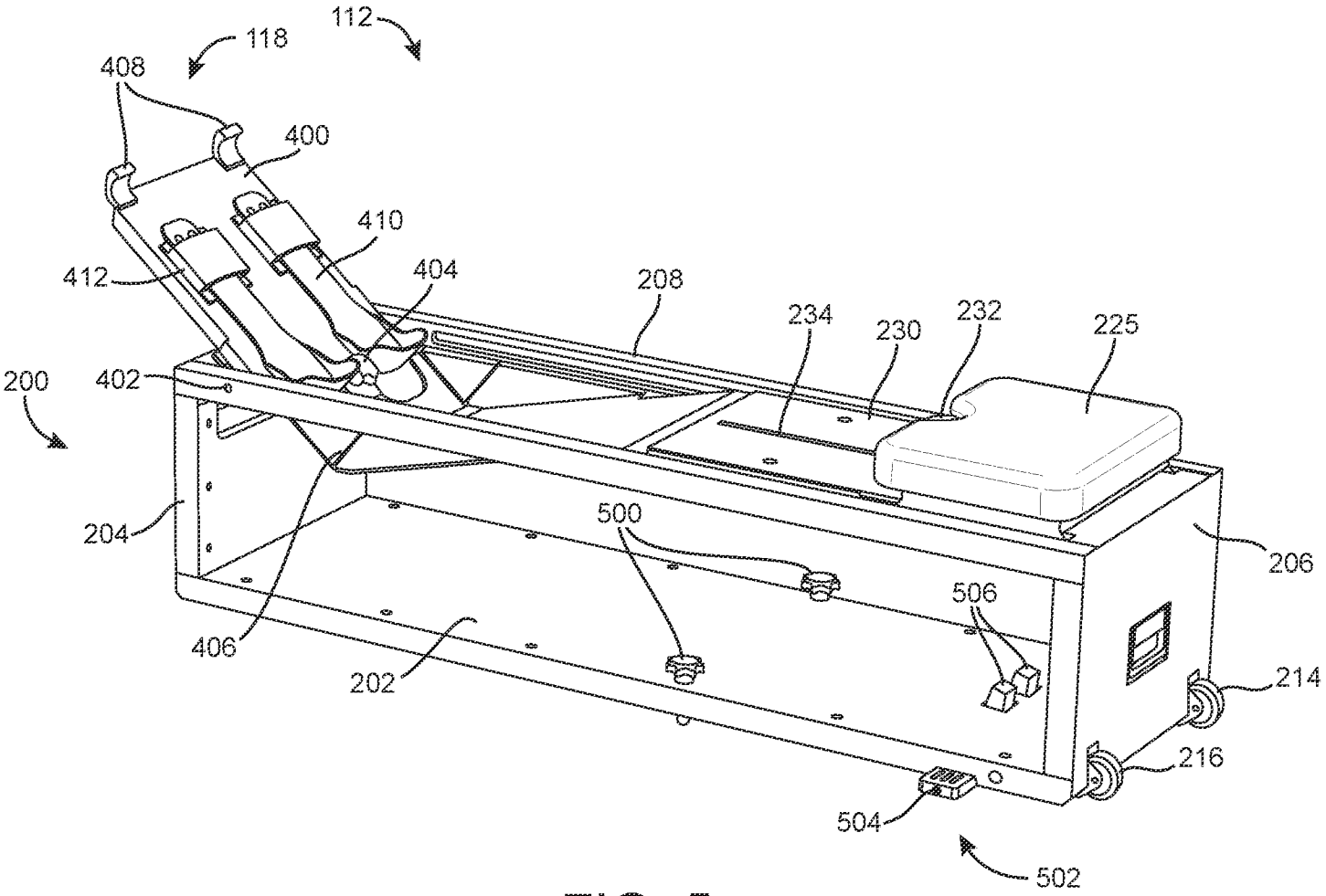
FIG. 5 is a perspective view of the multipurpose bench in a sliding configuration with a footrest extended, according to some embodiments.
Figure 6:
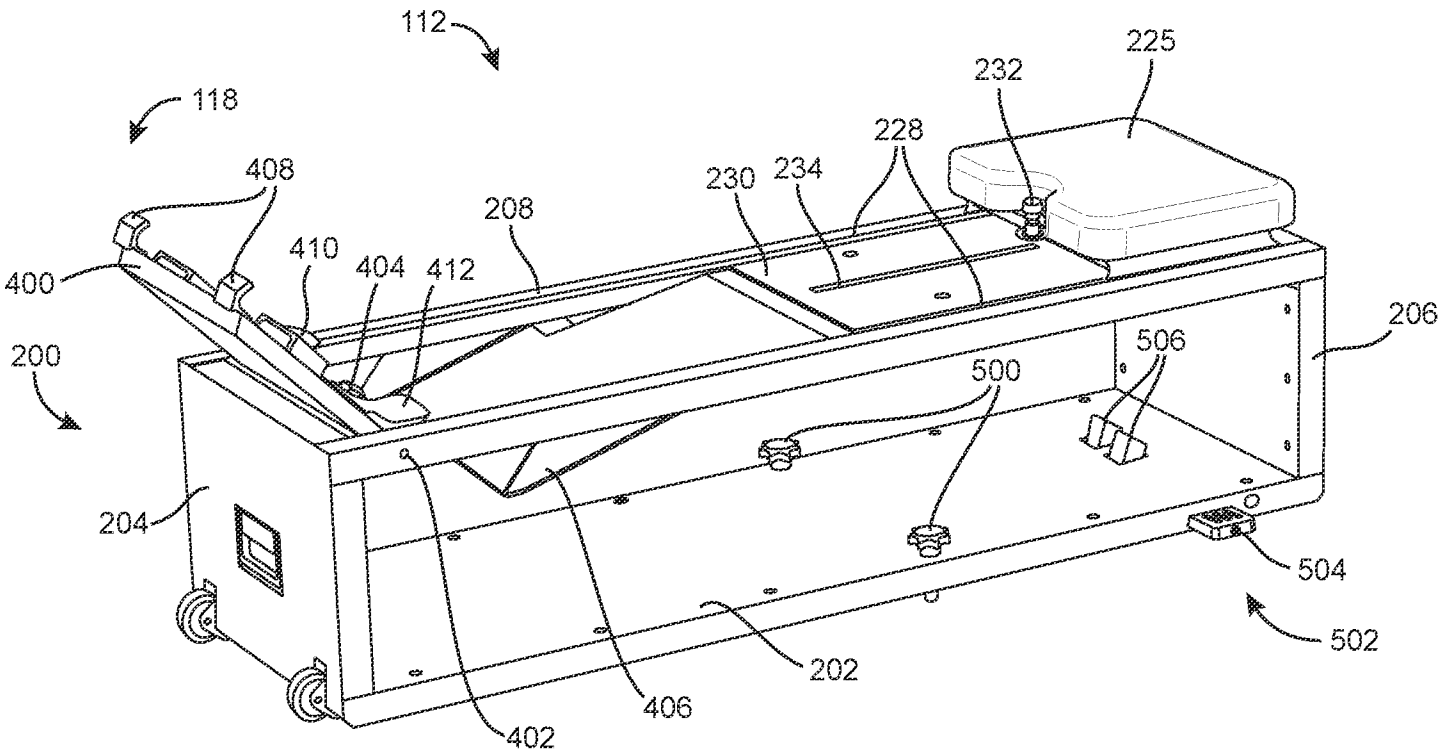
FIG. 6 is another perspective view of the multipurpose bench in a sliding configuration with a footrest extended, according to some embodiments.
Figure 7:
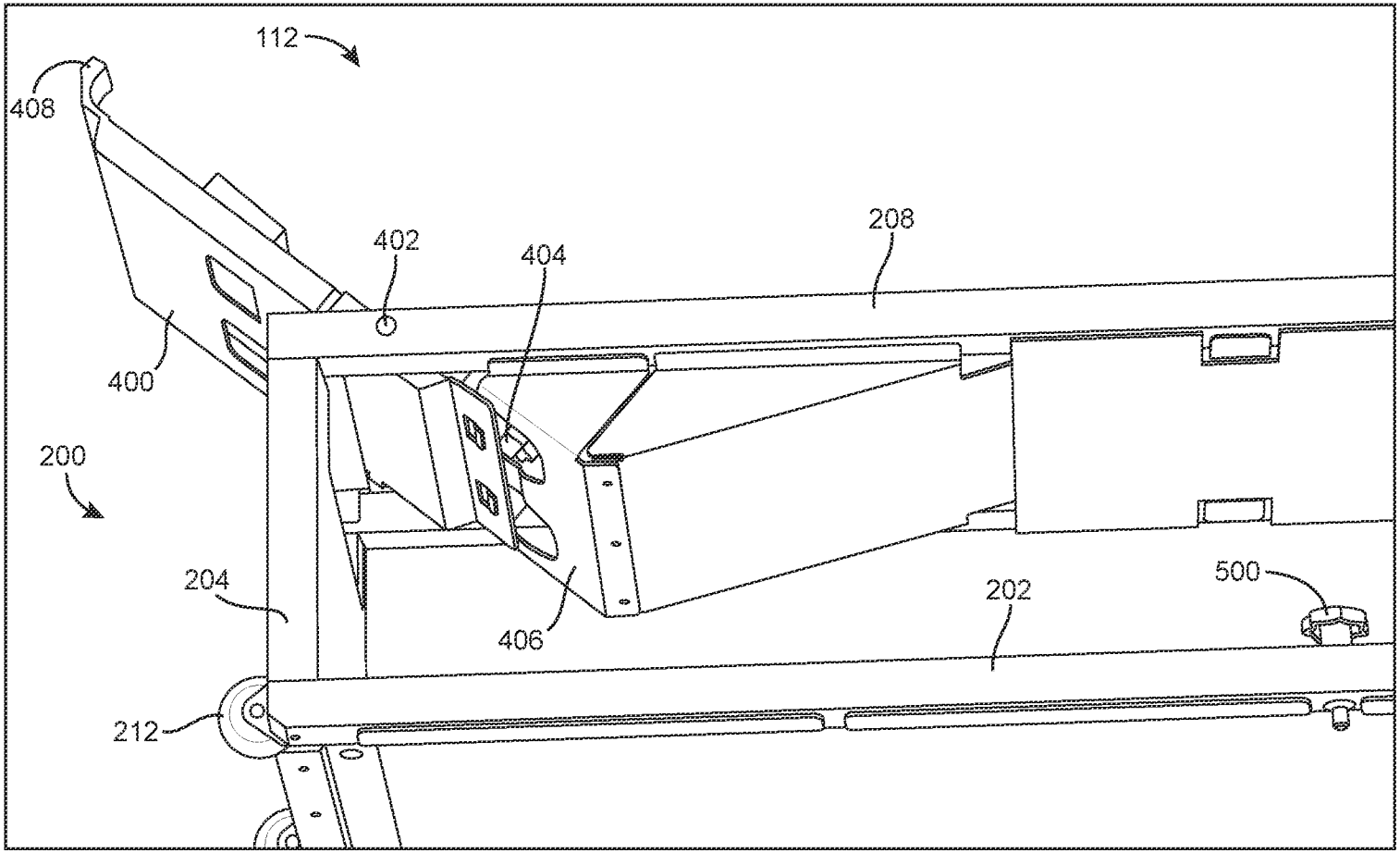
FIG. 7 is an underneath perspective view of a footrest of the multipurpose bench, according to some embodiments.
Figure 8:
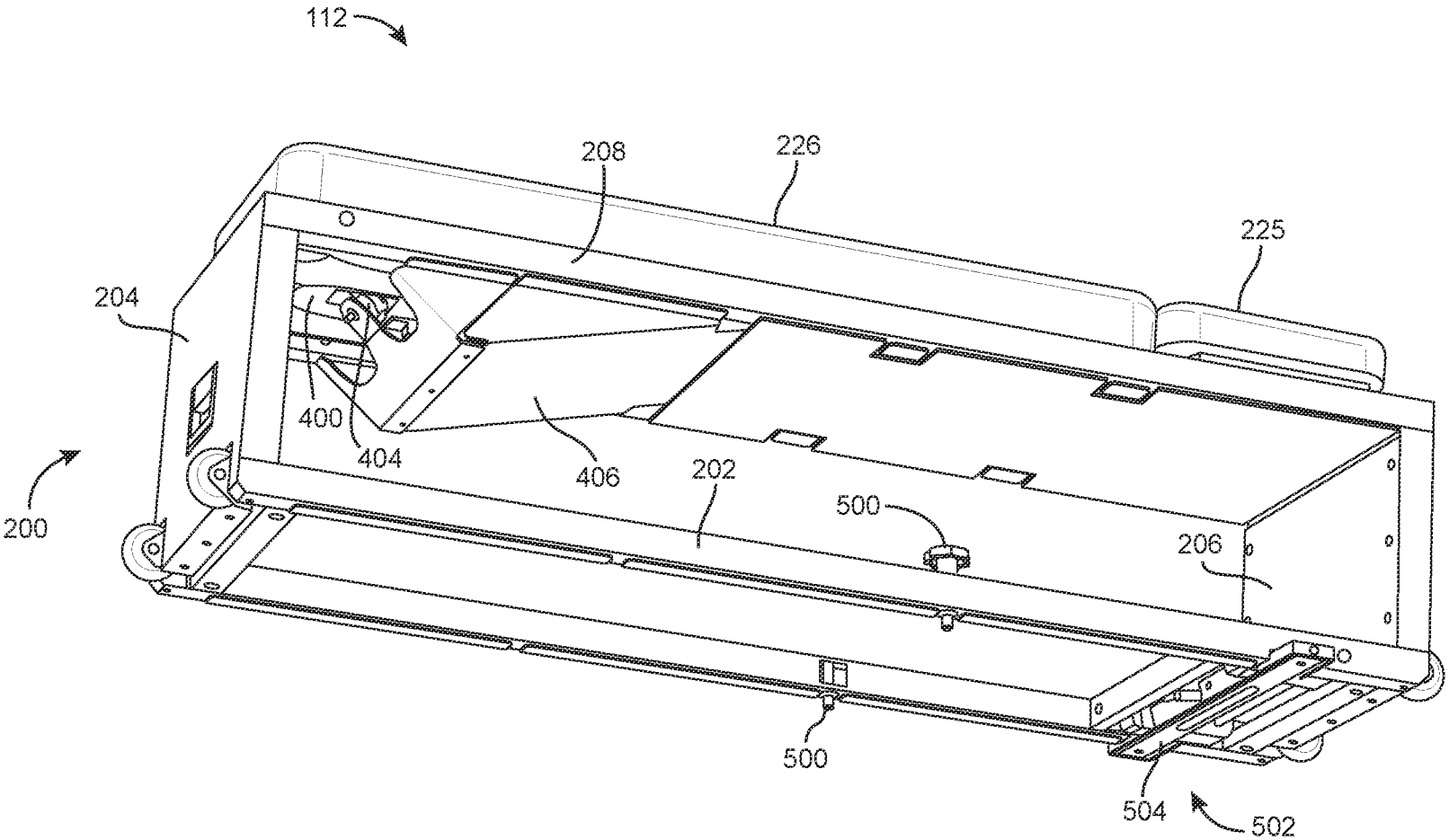
FIG. 8 is another perspective view of the multipurpose bench in a static support configuration, according to some embodiments.
Figure 9:
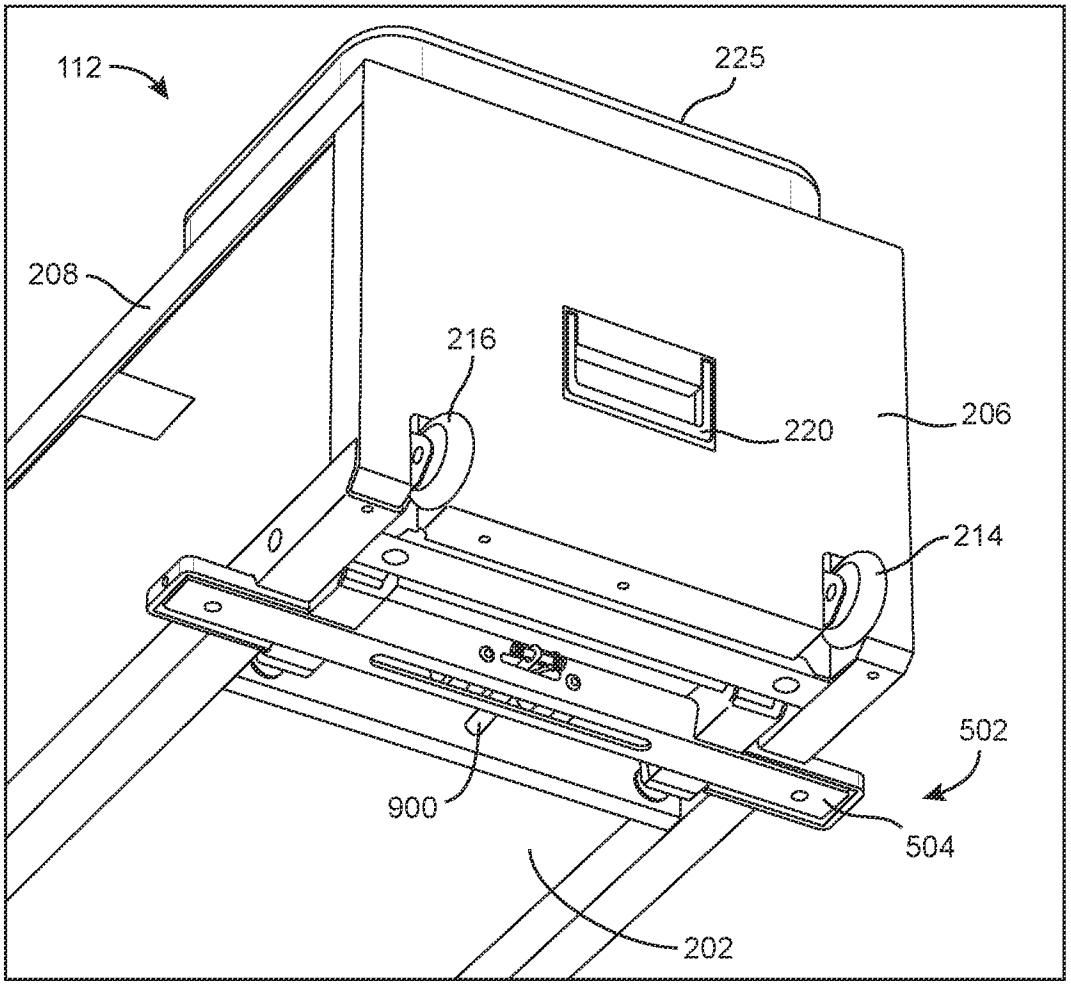
FIG. 9 is an end perspective view of the multipurpose bench, according to some embodiments.

Referring now to FIGS. 2-9, various perspective views of the bench 112 are shown in different configurations are shown, according to some embodiments. FIGS. 2 and 8 shows the bench 112 in a static support configuration, for example as configured be configured for use in the first step 102 of process 100, for example. FIGS. 3 and 4 show the bench 112 in a sliding configuration with the footrest 118 stowed in an out-of-use position, for example for use with Pilates or other exercises. FIGS. 5-7 show the bench 112 in a sliding configuration with the footrest 118 deployed in an in-use position, for example for use in a rowing exercise as illustrated for the third step 106 of process 100. FIG. 1

The bench 112 is shown as including a base 200 comprising a bottom panel 202, a first end wall 204, a second end wall 206, and a top frame 208. The base 200 is arranged as an open rectangular prism, with the first end wall 204 and the second end wall 206 supporting the top frame 208 above the base 200 and providing open space in a volume between the first end wall 204 and the second end wall 206 and between the top frame 208 and the bottom panel 202. The base 200 is configured to be substantially rigid and stable, e.g., to sit on a substantially flat surface without wobbling, swaying, etc.

The bench 112 is shown as including a first caster 210 and a second caster 212 positioned on the first end wall 204, and a third caster 214 and a fourth caster 216 positioned on the second end wall 206. The casters 210, 212, 214, 216 are configured to facilitate moving of the bench 112 (e.g., to move the bench 112 into position for an exercise, to move the bench 112 to a storage position/area, etc.), while also being positioned off of the ground, off of a support surface, etc. when the bench 112 is an in-use position with the bottom panel 202 parallel to the ground, support surface, etc. (i.e., such that the base 200 cannot roll on the casters 210, 212, 214, 216 while the bench 112 is in use). The bench 112 may also include handles, grips, etc. (e.g., first handle 218 on the first end wall 204; second handle 220 on the second end wall 206) that facilitate repositioning of the bench 112. For example, the bench 112 can be rotated upwards by lifting either the first handle 128 or the second handle 220, which brings the casters on the opposite end (i.e., casters 210, 212 if the second handle 220 is lifted; casters 214, 216 if the first handle 218 is lifted) into contact with the ground such that the bench 112 can be rolled along the ground to a different location.

The bench 112 is shown as including a user support surface including a seat 224 (e.g., seat 116) and a bench pad 226. The bench pad 226 is removeably placed on the top frame 208 of the base 200. As shown in the drawings, the seat 224 is positioned proximate (at, over) the second end wall 206 of the base 200. The bench pad 226 is shown as extending along a longitudinal axis of the bench 112, from the seat 224 to the first end wall 204 of the base 200. In the static support configuration as shown in FIGS. 2 and 8, the seat 224 and the bench pad 226 combine to substantially cover the base 200, for example with a border of the top frame 208 extending beyond the bench pad 226 to help support the bench pad 226 as illustrated in FIG. 2. The seat 224 and the bench pad 226 may include padded, compliant, soft, etc. stuffing and/or surfaces configured for user comfort and proper performance conditions to support performance of exercises by users siting on, lying on, etc. the seat 224 and the bench pad 226.

The bench pad 226, when positioned as in FIG. 2, may at least partially obstruct movement of the seat 224 such that the seat 224 is substantially prevented from sliding relative to the base 200 when the bench 112 is arranged in the static support configuration. The bench pad 226 may include one or more projections, extensions, cleats, hooks, etc. positioned on a bottom of the bench pad 226 and configured to engage the top frame 208 of the base 200 to prevent the bench pad 226 from sliding along the top frame 208 (i.e., horizontally) while enabling the bench pad 226 to be lifted vertically off of the base 200.

Lifting the bench pad 226 off of the base 200 transitions the bench 112 from the static support configuration shown in FIGS. 2 and 8 to a sliding configuration with the footrest 118 stowed as shown in FIGS. 3 and 4. The bench pad 226 may can be lifted off the base 200 and set aside to allow the bench 112 to be used without the bench pad 226. The seat 224 is separate from the bench pad 226 and can remain coupled to the base 200 when the bench pad 226 is removed, for example as illustrated in FIGS. 3 and 4.

In the example of FIGS. 2-4, the seat 224 is shown as being wider than the top frame 208 and includes hooks 229. The hooks 229 are configured to be coupled to cables of a force production system (e.g., exercise apparatus 114 of FIG. 1) to enable forces to be applied to the seat 224. Such forces can be used for Pilates reformer-style exercises, for example. The seat 224 may have a substantially-flat top surface on which a user can sit, lie, kneel, etc.

The seat 224 can include projections, pins, wings, etc. which rides in slots (grooves, tracks, etc.) 228 between the top frame 208 and a plate 230 coupled to the top frame 208. The plate 230 is aligned with the top frame 208 and parallel to the bottom panel 202. The slots 228 are parallel to a longitudinal axis of the base 200 and the bench 112. The seat 224 may include wheels, bearings, lubricant, etc. facilitating movement of the seat 224 along the slots 228, the plate 230, and the top frame 208, in various embodiments. In the example shown, the slots 228 and the top frame 208 extend along approximately half of a length of the bench 112 and define a range of motion of the seat 224.

In some embodiments, the seat 224 is interchangeable with one or more other seat designs, for example a seat 225 as shown in FIGS. 5, 6, 8, and 9 which may be configured for rowing exercises or other paddling exercises, for example a seat 225 contoured ergonomically to receive a user's legs, butt, etc. when the user sits on the seat 225, for example such that the seat 225 reduces or prevents sliding of the user along the seat 225. In some embodiments, the entire seat 224 is removable from the slots 228 to enable the seat 225 to be inserted into the slots 228 to provide the bench 112 with the seat 225. In some embodiments, the seat 224 includes an underlying structure which rides in the slots 228 and a removable portion which can be detached (e.g., by manipulating one or more clips, knobs, bolts, etc.) and replaced with a different removable portion to provide the seat 225 (such that the seat 224 and the seat 225 use the same underlying structure which rides in the slots 228). The seat 225 suitable for a rowing exercise can thus be installed in accordance with the views of FIGS. 5, 6, and 8, for example.

In the example of FIGS. 5 and 6, the seat 225 includes a pin lock 232. The pin lock 232 is shown as interfacing with a slot 234 in the plate 230. The pin lock 232 is operable to selectively lock the seat 225 in a position along the plate 230 by interfacing with the slot 234 and the plate 230 (e.g., using a spring-loaded mechanism). The pin lock 232 can be manipulated to an unlocked position which enables the seat 225 to freely slide along the bench 112. The pin lock 232 thereby allows the seat 225 to be used in both a sliding configuration and a static configuration. The static configuration (With the pin lock 232 engaging the slot 234) can be used with or without the bench pad 226 in various embodiments.

The bench 112 is further illustrated as including a footrest 118. The footrest 118 is illustrated as being moveable (e.g., rotatable) between a stowed, out-of-use position (for example as is visible in FIGS. 3-4) and a deployed, in-use position (for example as shown in FIGS. 5-7). The stowed, out-of-use position of the footrest 118 allows the bench pad 226 to be placed in position on the base 200 to provide static support configuration of FIG. 2 and can enable exercises using the sliding configuration for which the foot rest is not needed or would be in a user's way. The deployed, in-use position of the footrest 118 enables a user's feet to interact with the footrest 118 during an exercise, for example a rowing exercise for which a user sits on the seat 225 and places the user's feat on the footrest 118.

The footrest 118 is shown as including a platform 400 rotatable about an axel or set of rotation points 402. The platform 400 can rotate from an orientation parallel to and aligned with the top frame 208 and the plate 230 (i.e., the stowed, out-of-use position) by an amount greater than ninety degrees (e.g., approximately 135 degrees) to an orientation forming an obtuse angle between the platform 400 and the top frame 208. At the platform 400's maximum angle (i.e., at its position when deployed), the platform 400 may hit against a top end of the first end wall 204 (or a portion of the top frame 208 at the first end wall 204) to define a rotational limit of the platform 400. The footrest 118 can be provided with a bolt 404 or other retention mechanism (clip, cleat, pin lock, etc.) which can be manipulated (e.g., turned, tightened) to selectively retain the footrest 118 in the deployed position as shown in FIGS. 5-7. For example the bolt 404 may selectively engage both the platform 400 and a well structure 406 coupled to the top frame 208, with the well structure 406 at least partially housing or receiving at least part of the footrest 118 when the footrest 118 is in the deployed position and/or the stowed position.

The footrest 118 is further shown as including bar hooks 408. The bar hooks 408 extend from a distal end of the platform 400 and are configured to engage a bar of an exercise apparatus (e.g., exercise apparatus 114), for example a bar subject to cable tension pulling the bar toward the bar hooks 408 and away from the seat 225 such that the bar is prevented from moving beyond the bar hooks 408 in the direction of such tension. A user can engage the bar with the bar hooks 408 as a starting place for an exercise, as a resting point between repetitions of an exercise, and/or at the end of an exercise.

The footrest 118 is further shown as including a right foot baskets 410 to receive a user's right foot and a left foot basket 412 to receive a user's left foot. The foot baskets 410, 412 may be adjustable in position along the platform 400, for example to fit different sized feet of different users. The foot baskets 410, 412 may include straps operable to hold the user's feet on the foot baskets 410, 412. Each foot baskets 410, 412 may be attached to the platform 400 at a toe region or proximate the ball of the user's foot so that the heel region of the foot basket 410, 412 can lift slightly off of the platform 400 to provide a range of motion suitable for a rowing exercise. The footrest 118 thereby enables a user to push and pull with the user's feet on the footrest 118 in a manner that enables performance of a rowing exercise using the bench 112.

The bench 112 is further shown to include bolts 500 positioned on and extending through the bottom panel 202 of the base 200, according to some embodiments. In such embodiments, the bolts 500 extend out of the base 200 in a downward direction and are configured to engage corresponding threaded holes of a support surface, base, platform, deck, floor, etc. of an exercise apparatus (e.g., exercise apparatus 114). When engaged with such corresponding threaded holes, the bolts 500 retain the bench 112 in position relative to the exercise apparatus, for example such that forces exerted by a person on the exercise apparatus move a moveable portion of the exercise apparatus (e.g., bar, cable, handle, etc.) rather than the bench 112. The bolts 500 can include knobs enabling easy turning of the bolts 500 by hand to attach and detach the bench 112 from the support surface (platform, deck, etc.). The weight of the bench 112, frictional members included on a bottom of the bench 112, etc. may also resist undesired movement of the bench 112 relative to an exercise apparatus in various embodiments.

In some embodiments, the bench 112 also includes a kickstand 502. The kickstand 502 can be used to support the bench 112 in scenarios where a portion of the bench 112 (e.g., an end of the bench 112 including the second end wall 206 extends beyond a platform, deck, support surface, etc. (e.g., of exercise apparatus 114) supporting a remainder of the bench 112. Such positioning may be useful for a variety of exercises, and enables the bench to be used with such a platform, deck, etc., in a greater range of positions (including fully on the platform and partially on the platform). The kickstand 502 is shown as including a footplate 504 and projections 506, with the footplate 504 on an underside of the bottom panel 202 of the base 200 and the projections 506 extending through the bottom panel 202. The kickstand 502 is also shown as including a pivoting rod 900 coupled to the footplate 504 and the bottom panel 202. The footplate 504 can be extended downward from the bottom panel 202 to an extended position by movement of the projections 506 and the pivoting rod 900 (e.g., in response to a user pushing on the footplate 504), with the structure of the kickstand 502 (e.g., the pivoting rod 900, the projections 506). Kickstand 502 may be held in the extended position by a spring force (and forced into a retracted position by the vertical weight of the bench and user), such that the footplate 504 can support a load from the bench 112 (e.g., to provide stability to the bench 112 when the footplate 504 is positioned on a lower surface (e.g., the ground, the floor) compared to another surface supporting other parts of the bench 112 (e.g., a platform, deck, etc. of an exercise apparatus). The projections 506 may fit into a mating receptacle on the bottom panel 202 of the bench 112, which can provide additional stability and resistance to unwanted motion of the bench 112. The kickstand 502 can be released by a user to draw the footplate 504 back to the bottom panel 202 to a retracted position so that the entire bench 112 can be placed on a common flat surface. The kickstand 502 thus provides a user-friendly structure for along the bench to be placed on one surface or multiple surfaces.

Figure 10:
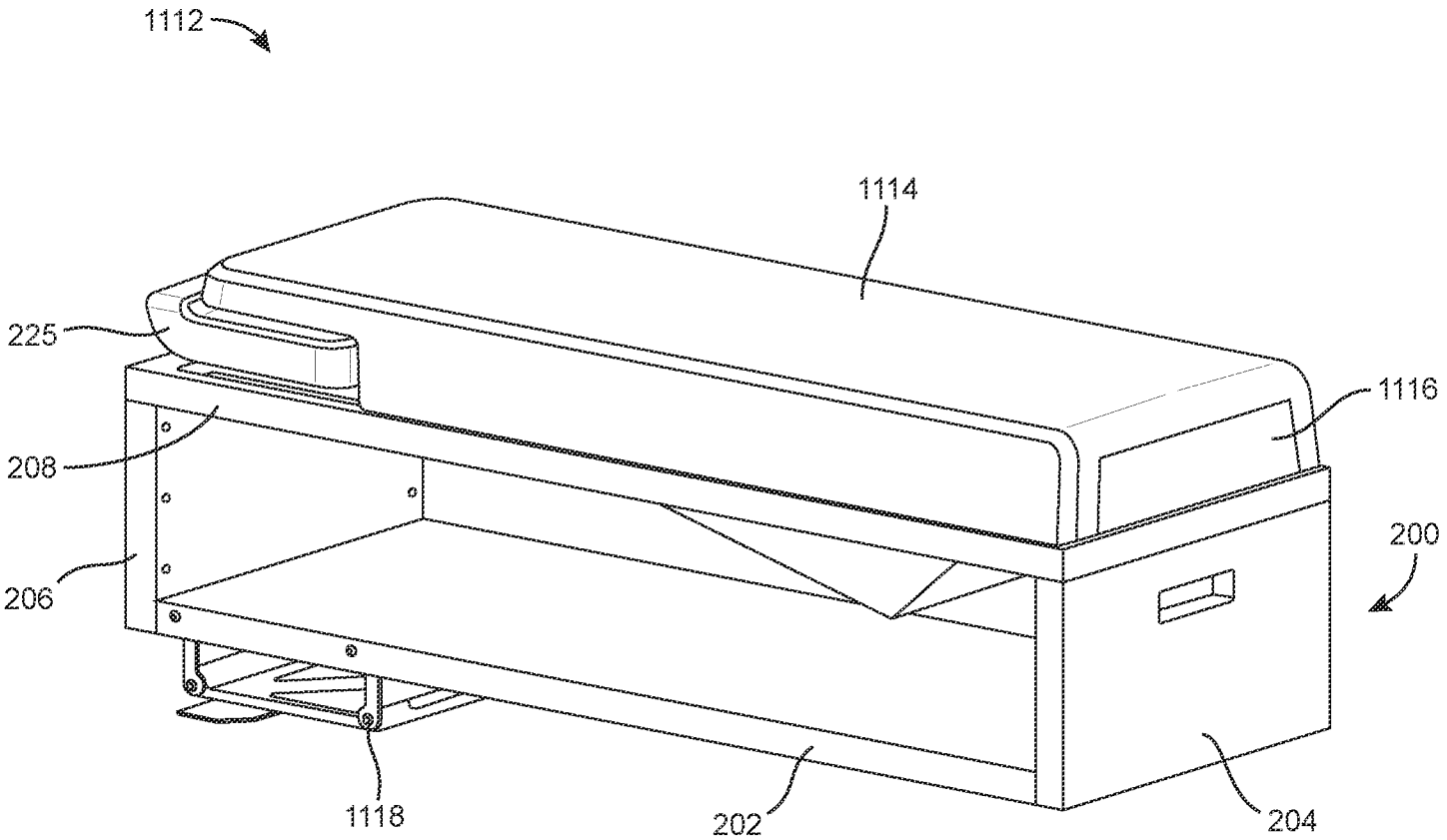
FIG. 10 is a perspective view of another multipurpose bench, according to some embodiments.
Figure 11:
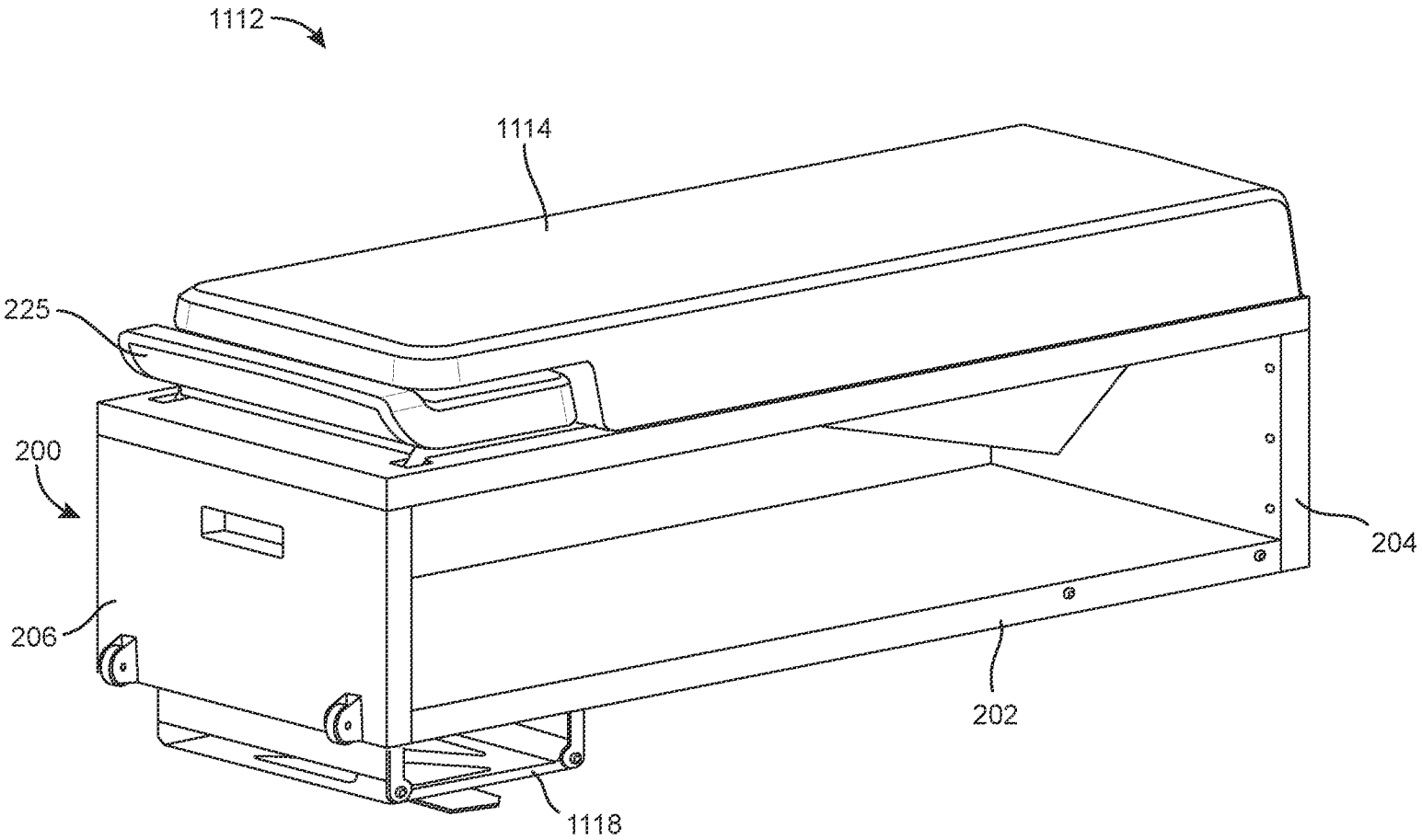
FIG. 11 is another perspective view of the multipurpose bench of FIG. 11, according to some embodiments.

Referring now to FIGS. 10-11, perspective views of another bench 1112 is shown, according to some embodiments. The bench 1112 is a multipurpose or multifunction bench suitable for use in process 100 and may include many of the structural elements of the bench 112, such that description of FIGS. 10-11 focuses on differences shown for the bench 1112 with like reference numbers retained for comparable components for ease of description.

The bench 1112 is shown as including a removable bench cover 1114 (e.g., in place of bench pad 226). The removable bench cover 1114 is positioned on the top frame 208 and configured to extend over the seat 225 (to cover the seat 225). The removable bench cover 1114 thereby provides a surface on which a user can sit, lay, etc. which is substantially coextensive with a top of the bench 1112. The removable bench cover 1114 may also be contoured to extend around, over, etc. a footrest extension 1116 which is shown in FIG. 10 as extending above the first end wall 204. In the embodiment of FIGS. 10-11, a static footrest may thus be provided, i.e., a footrest usable without rotating, repositioning, etc. as for other embodiments herein.

The bench 1112 is further shown as including a support box 1118 positioned on a bottom of the bench 1112 below the seat 225. The support box 1118 is configured to provide support to the bench 1112 when the bench 1112 is positioned partially on a platform, deck, etc. (e.g., of an exercise apparatus) such that the support box 1118 bears partial weight of the bench 1112 and prevents instability of the bench 1112. The support box 1118 may include joints, rotating members, etc. which enable adjustment of a height of the support box 1118 and/or enable retraction of the support box 1118, in various embodiments.

Figure 12:
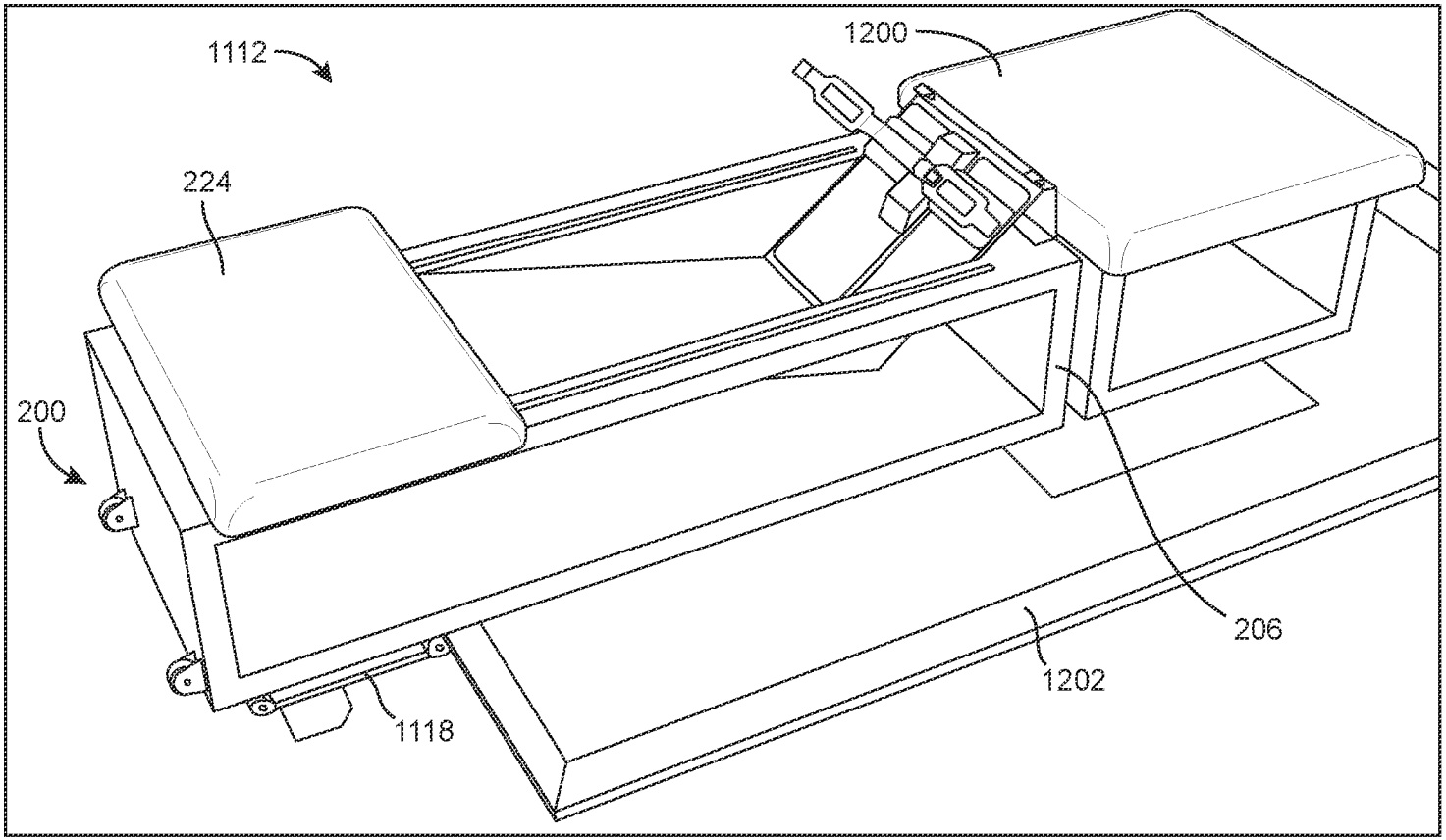
FIG. 12 is a perspective view of a multipurpose bench in use with a pedestal, according to some embodiments.

Referring now to FIG. 12, a view of the bench 1112 in use with a pedestal 1200 is shown, according to some embodiments. In the example of FIG. 12, the bench 1112 is shown as extending off of a platform 1202 of an exercise apparatus (e.g., exercise apparatus 114), such that the support box 1118 is used to support and end of the bench 1112. Such positioning allows space for inclusion of pedestal 1200 proximate the second end wall 206 of the bench 1112 (as shown, on the platform 1202). The pedestal 1200 is approximately the same height as the bench 1112 and provides a static padded surface at approximately the same height as the seat 224 of the bench 1112 in the configuration shown in FIG. 12. The pedestal 1200 and the sliding seat 224 can be used in combination for various exercises, for example Pilates reformer-style exercises. In some such embodiments, cables of an exercise apparatus are attached to the sliding seat 224 to provide a force drawing the sliding seat 224 toward the pedestal 1200, which can contribute to exercises performed by a user positioned on the seat 224 and the pedestal 1200. Various exercise experiences can thus be enabled by the teachings herein.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

As utilized herein with respect to numerical ranges, the terms "approximately," "about," "substantially," and similar terms generally mean +/−10% of the disclosed values. When the terms "approximately," "substantially," and similar terms are applied to a structural feature (e.g., to describe its shape, size, orientation, direction, etc.), these terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

Although the figures and description may illustrate a specific order of method steps, the order of such steps may differ from what is depicted and described, unless specified differently above. Also, two or more steps may be performed concurrently or with partial concurrence, unless specified differently above. All such variations are within the scope of the disclosure. The construction and arrangement of the systems, benches, etc. as shown in the various e embodiments is illustrative. Any element disclosed in one embodiment may be incorporated or utilized with any other embodiment disclosed herein, and elements may be omitted from the embodiments herein.

What is claimed is:

1. An exercise bench comprising:

a base;

a slidable seat coupled to and slidable along the base;

a removable pad positionable on a frame, wherein, when the removable pad is positioned on the frame, the removable pad prevents movement of the slidable seat along the base and provides a static bench surface configured to support a user during a strength training exercise;

a footrest coupled to the base, the footrest comprising a hook configured to restrict motion of a bar of an exercise apparatus.

2. The exercise bench of claim 1, wherein the footrest comprises foot baskets adapted for a rowing exercise.

3. The exercise bench of claim 1, wherein the footrest is rotatable between a stowed position and a deployed position.

4. The exercise bench of claim 3, wherein the footrest is in the stowed position when the removable pad is positioned on the frame.

5. The exercise bench of claim 3, wherein the footrest comprises a bolt operable to selectively secure the footrest in the deployed position and release the footrest from the deployed position.

6. The exercise bench of claim 1, wherein the slidable seat comprises a first removable portion configured to be replaced with a second removable portion, the first removable portion and the second removable portion having different dimensions.

7. The exercise bench of claim 1, wherein the slidable seat comprise a pin lock configured to interface with a track coupled to the base, wherein the pin lock is operable to selectively prevent or allow sliding of the slidable seat when the removable pad is not positioned on the frame.

8. The exercise bench of claim 1, wherein the base comprises a kickstand configured to partially support the base when the base is positioned over two surfaces or on an uneven surface.

9. The exercise bench of claim 1, wherein the base comprises a bolt positioned at bottom of the base, wherein the bolt is structured to selectively secure the base to a support surface for the base.

10. An exercise bench, comprising:

a base;

a slidable seat coupled to and slidable along the base; and a removable pad positionable on a frame, wherein, when the removable pad is positioned on the frame, the removable pad prevents movement of the slidable seat along the base and provides a static bench surface configured to support a user during a strength training exercise;

wherein the slidable seat comprises a hook configured to be attached to a cable of an exercise apparatus.

11. The exercise bench of claim 10, further comprising a footrest coupled to the base.

12. The exercise bench of claim 11, wherein the footrest comprises a hook configured to restrict motion of a bar of an exercise apparatus.

13. An exercise system, comprising:

a motorized force production system configured to provide a first force enabling a strength training exercise; and an exercise bench comprising:

a base;

a slidable seat coupled to and slidable along the base; and a removable pad positionable on a frame, wherein, when the removable pad is positioned on the frame, the removable pad prevents movement of the slidable seat along the base and provides a static bench surface configured to support a user during the strength training exercise;

wherein the motorized force production system is further configured to provide a second force enabling a Pilates exercise, wherein the slidable seat comprises a hook configured to couple to a cable of the motorized force production system such that the second force is exerted on the slidable seat.

14. The exercise system of claim 13, wherein the motorized force production system is further configured to provide a third force enabling a rowing exercise, wherein the slidable seat is configured to slide along the base during performing of the rowing exercise.

15. The exercise system of claim 14, wherein the exercise bench further comprises a footrest configured to facilitate the rowing exercise, wherein the footrest is accessible when the removable pad is not positioned on the frame and inaccessible when the removable pad is positioned on the frame.

16. The exercise system of claim 13, wherein:

the motorized force production system comprises a platform;

a first end of the exercise bench is positioned on the platform and a second end of the exercise bench is positioned off of the platform; and the exercise bench further comprises a kickstand proximate the second end and configured to support the second end of the exercise bench.

17. A method of using a multipurpose exercise bench, comprising:

performing a strength training exercise while sitting or lying on a removable pad positioned on the multipurpose exercise bench, the removable pad providing a static support surface;

enabling sliding of a slidable seat of the multipurpose exercise bench by removing the removable pad from the multipurpose exercise bench; and changing an attachment point of a handle or bar to a cable of a motorized force production system between the strength training exercise and an endurance training exercise; and performing the endurance training exercise by sliding along the multipurpose exercise bench on the slidable seat.

18. The method of claim 17, further comprising deploying a footrest of the multipurpose exercise bench by rotating the footrest relative to a base of the multipurpose exercise bench, wherein performing the endurance training exercise comprises pushing or pulling a foot against the footrest.

* * * * *